US006323820B1

(12) United States Patent
Haunberger

(10) Patent No.: US 6,323,820 B1
(45) Date of Patent: Nov. 27, 2001

(54) MULTIBAND ANTENNA

(75) Inventor: Thomas Haunberger, Bad Reichenhall (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 09/700,088

(22) PCT Filed: Mar. 16, 2000

(86) PCT No.: PCT/EP00/02356

§ 371 Date: Nov. 16, 2000

§ 102(e) Date: Nov. 16, 2000

(87) PCT Pub. No.: WO00/57514

PCT Pub. Date: Sep. 28, 2000

(30) Foreign Application Priority Data

Mar. 19, 1999 (DE) ..... 199 12 465

(51) Int. Cl.[7] ..... H01Q 9/16

(52) U.S. Cl. ..... 343/793; 343/795; 343/822; 343/876

(58) Field of Search ..... 343/793, 702, 343/905, 797, 795, 822, 815, 824, 834, 876

(56) References Cited

U.S. PATENT DOCUMENTS 2,619,596 11/1952 Kolster .
2,886,813 * 5/1959 Hings ..... 343/819
5,485,167 * 1/1996 Wong et al. ..... 343/753
5,977,928 * 11/1999 Ying et al. ..... 343/790
6,025,811 * 2/2000 Canora et al. ..... 343/793
6,211,840 * 4/2001 Wood et al. ..... 343/793

FOREIGN PATENT DOCUMENTS 963 794 11/1956 (DE) .
37 14 382 11/1989 (DE) .
0 823 751 2/1998 (EP) .
0 887 880 12/1998 (EP) .

* cited by examiner

*Primary Examiner*—Tho Phan
(74) *Attorney, Agent, or Firm*—Nixon & Vanderhye

(57) ABSTRACT

A multiband antenna has first and second antenna devices for transmitting or receiving. Each device has a dipole structure and associated dipole halves disposed opposite a base plate or reflector by baluns. The antenna devices are provided with a feed from a common antenna input line and a branch circuit. Frequency selective components are respectively associated with the first and second antenna devices. An electrical length of branch lines between a branch point and a feed point on the associated antenna devices having the dipole structure enables the frequency selective components respectively to reject a frequency band range transmitted via another of the first and second antenna devices.

10 Claims, 3 Drawing Sheets

MULTIBAND ANTENNA

The invention relates to a multiband antenna in accordance with the precharacterizing clause of claim 1.

The mobile radio field is mostly dealt with over the GSM 900 network, that is to say in the 900 MHz range. In addition, the GSM 1800 standard has also become established, where signals can be received and transmitted in an 1800 MHz range.

For such multiband base stations, multiband antenna devices for transmitting and receiving various frequency ranges are therefore required which usually have dipole structures, that is to say a dipole antenna device for transmitting and receiving the 900 MHz band range and a further dipole antenna device for transmitting and receiving the 1800 MHz band range.

Figure 1:
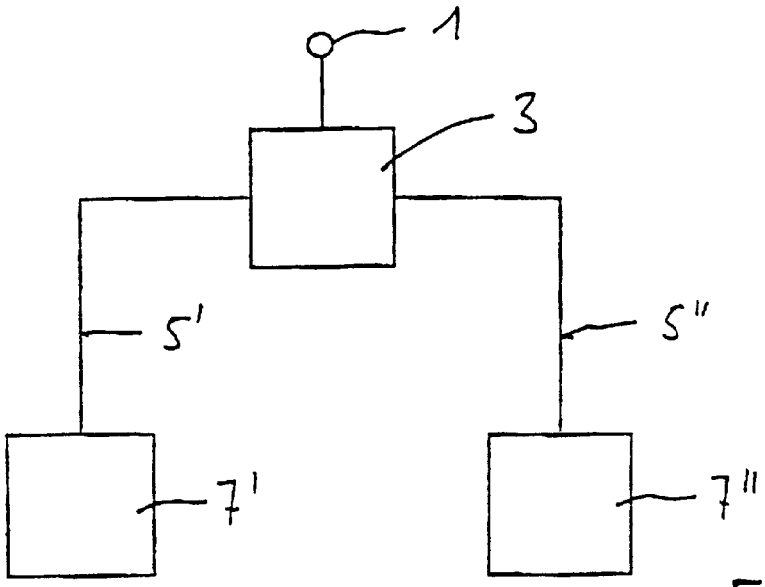
Fig. 1 (Prior Art)

An antenna device known from the prior art is schematically shown in FIG. 1.

Such a known antenna device comprises a common antenna input 1 which has a combiner circuit 3 arranged downstream of it on the antenna side, in order to permit appropriate decoupling of the signals transmitted in the various frequency ranges.

Arranged downstream of this combiner or branch circuit 3 are two branch lines 5' and 5" which are respectively connected to the first antenna device 7' and to the second antenna device 7" in order to use them to handle the radio traffic in the first and second band ranges.

To this end, the branch circuit 3 is provided with integrated frequency-selective components, for example of bandpass filter type, which cause each of the two branch lines 5' and 5" to reject the band range of the other antenna device.

The object of the present invention is to provide, on the basis of the prior art illustrated, a comparatively simple dual-band antenna which is of economical design.

The invention achieves the object on the basis of the features specified in claim 1. Advantageous refinements of the invention are specified in the dependent claims.

It must be hailed as thoroughly amazing and surprising that it is possible to dispense with a conventional combiner or branch circuit. This is because the frequency-selective components, which are also required in accordance with the invention, need not be produced by separate components integrated in the combiner circuit, unlike in the prior art, but rather can, in accordance with the invention, be integrated in the antenna device itself.

The components concerned can be integrated in the antenna device merely as a result of an appropriate design for the balun and the relevant antenna device's effective electrical line length starting from the branch point, without requiring separate components for this, as in the prior art.

It has been found to be particularly beneficial to adapt the balun using shorting devices which can be incorporated between the balun. The size and arrangement of these shorting devices can be used to adapt the effective electrical length of the balun such that each frequency-selective component (for example of bandpass filter type) integrated in the relevant antenna device rejects, that is to say is operated as an open circuit for, the respective frequency of the second antenna device for the other frequency band range.

Figure 2:
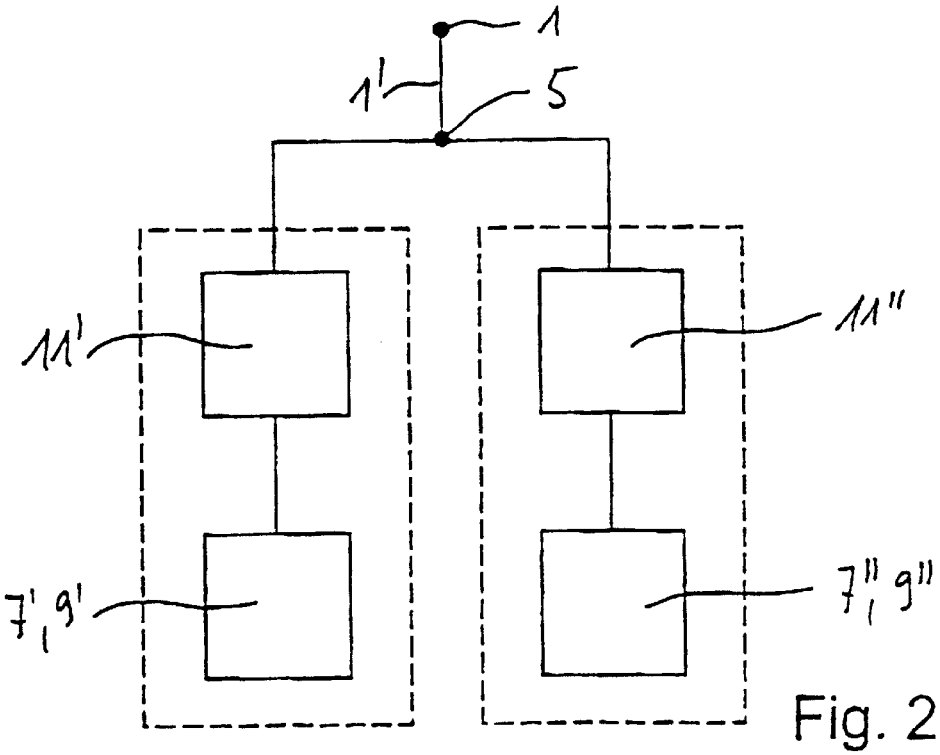
Figure 3:
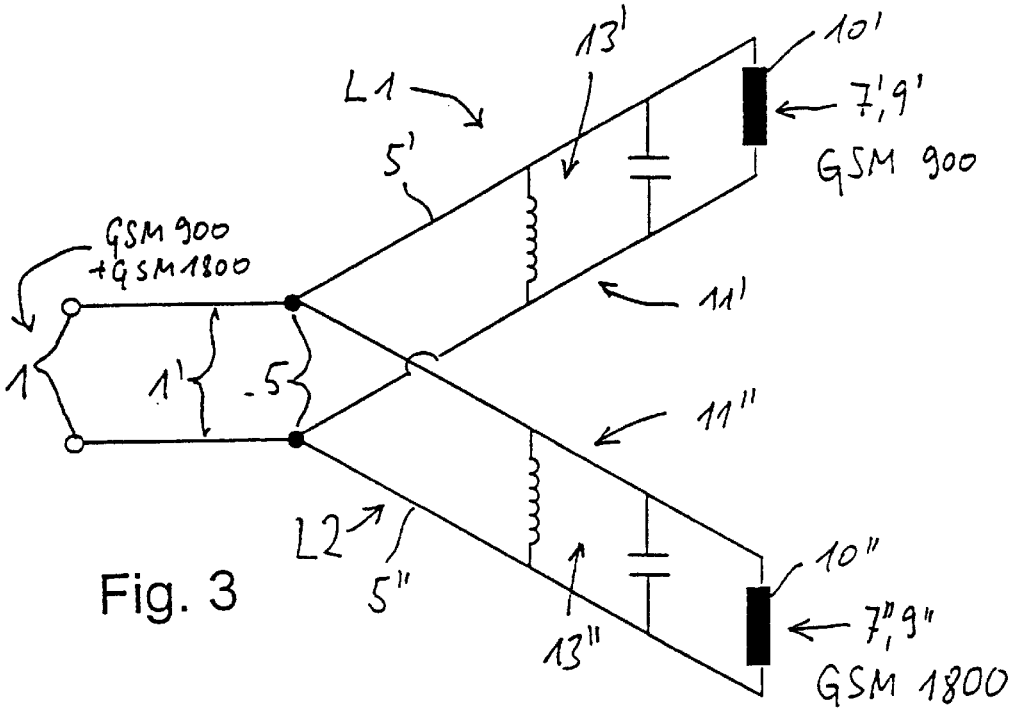
Figure 5:
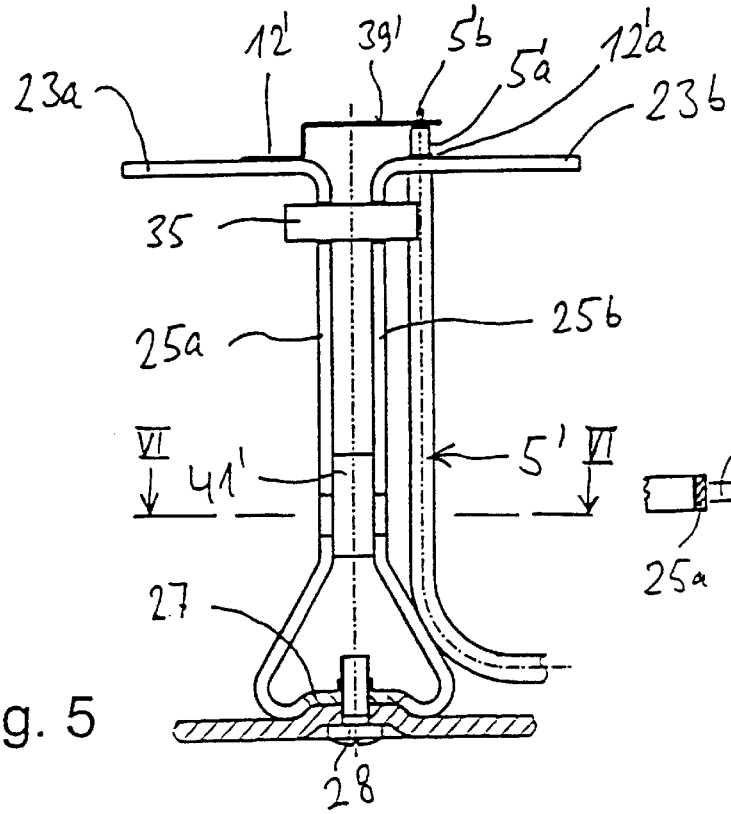
Figure 6:
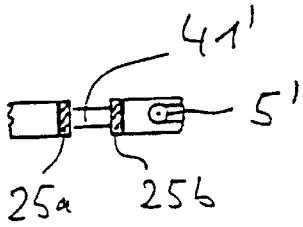
Figure 4:
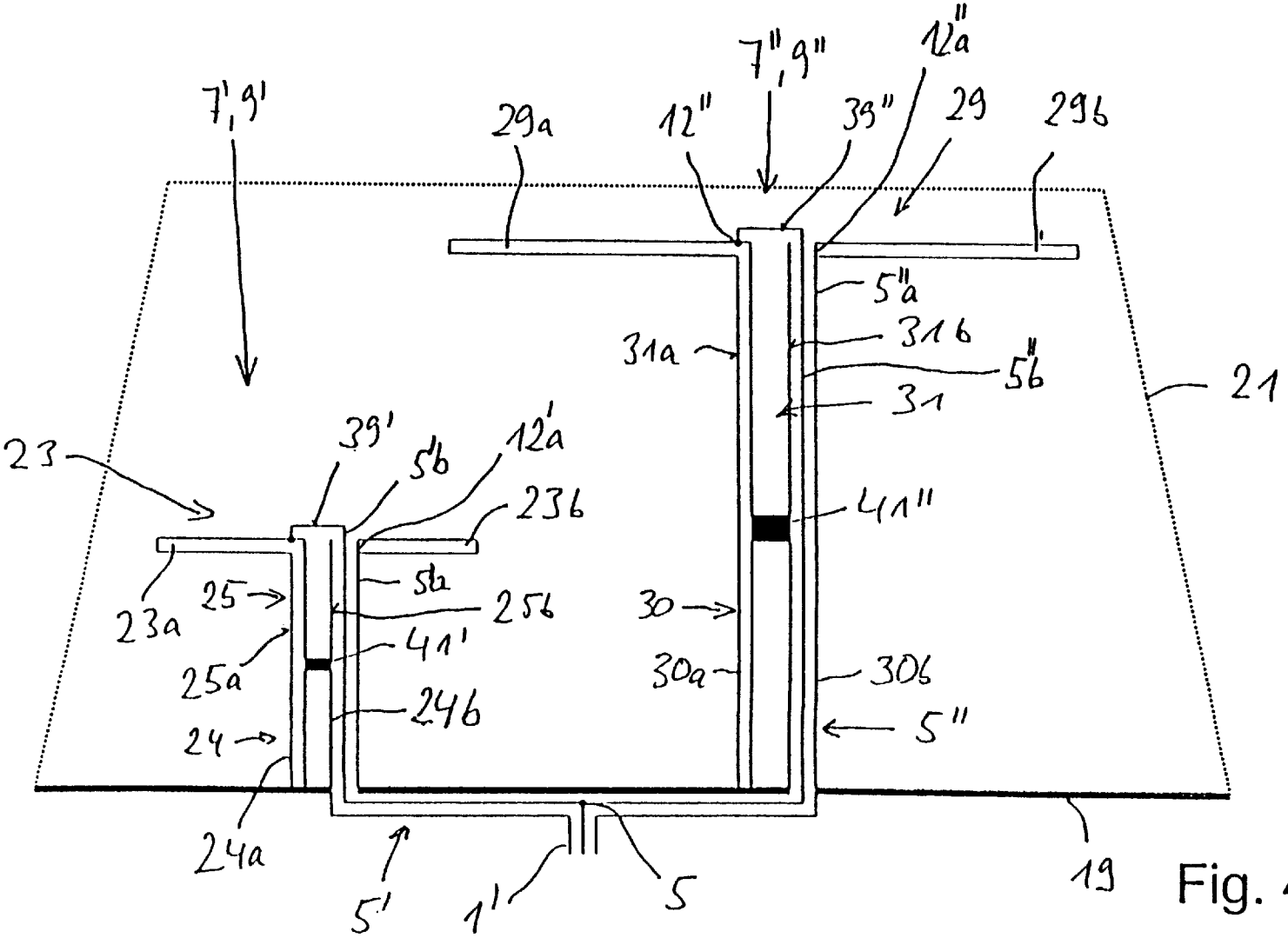

The invention is explained in more detail below with the aid of an illustrative embodiment. In this context, in detail:

FIG. 1: shows a schematic block diagram to explain a dual-band antenna in accordance with the prior art;

FIG. 2: shows a schematic block diagram, which has been modified as compared with FIG. 1, to explain the dual-band antenna according to the invention;

FIG. 3: shows a basic block diagram to explain the way in which the dual-band antenna according to the invention works;

FIG. 4: shows a schematic cross-sectional illustration through an illustrative embodiment of the dual-band antenna according to the invention;

FIG. 5: shows a schematic, detailed side illustration of one of the dual-antenna devices shown in FIG. 4 for the purpose of further explaining the feed and the arrangement of a shorting element; and FIG. 6: shows a detailed plan view along the sectional illustration VI—VI in FIG. 5.

FIG. 2 shows, in a departure from a dual-band antenna known from the prior art, as shown in FIG. 1, that, instead of the actual branch circuit, the invention provides only a branch point or sum point, also called star point 5 below, at which an antenna input line 1' is electrically branched into the two branch lines 5' and 5".

Each of these two branch lines 5' , 5" is connected to the two antenna devices 7' and 7", which each comprise a radiating element 9' and 9" having a dipole structure, in the form of two $\lambda/2$ dipoles in the illustrative embodiment shown (FIG. 4).

Integrated in this radiating element arrangement 9', 9" is more or less a respective associated frequency-selective component 11', 11" which is determined by the function comprising the balun of the dipole radiating elements 9', 9" and the associated electrical line length between the branch point 5 and the feed point on the associated dipole radiating element.

As can be seen from the basic illustration shown in FIG. 3, the feed for such a dual-band antenna comes via a common antenna input 1, i.e. a common antenna input line 1', which is used to supply the frequency signals for transmission in the GSM 900 or GSM 1800 frequency band range. The feed preferably comes via a coaxial line, FIG. 3 showing the coaxial line, i.e. the inner conductor and the outer conductor, as a two-conductor circuit to explain the circuit principle.

Given an appropriate radiation resistance 10' or 10" for the GSM 900 antenna or the GSM 1800 antenna, it is now possible to adapt and optimize the required frequency-selective component, for example in the form of a bandpass filter, such that two respective resonant circuits 13, 13" are formed which each reject, that is to say are operated as an open circuit for, the frequency of the other antenna. To this end, as already mentioned, the sum electrical length of the respective branch line 5' or 5" between the distribution point or star point 5 and the respective feed point on the associated antenna device 7', 7", including the subsequent length from the feed point 12' or 12*a*" to the shorting element, which is explained further below, should be chosen on the basis of the formulae specified below, so that the frequency-selective components or bandpass filters explained can optimally fulfill their respective rejection function for the frequency band range of the other antenna, on the basis of the formulae detailed further below.

Reference is made below to the further FIGS. 4 ff., which relate to a specific illustrative embodiment.

FIG. 4 shows a schematic representation, in a vertical sectional illustration, of a dual-band antenna which is constructed on a [lacuna] in the form of a reflector 19, which is also used as the baseplate for constructing the antenna arrangement, the dual-band antenna being provided with a removable housing 21 which is permeable to electromagnetic radiation.

Provided inside the housing 21 is a first antenna device 7', i.e. a first radiating element 7' for operation on the basis of the GSM 1800 standard, specifically in the form of a dipole 23. The two dipole halves 23*a* and 23*b* are seated at the top end of an associated support 24, the two support halves 24*a*, 24*b* being of integral design in the illustrative embodiment shown and being formed by appropriate bending and turning, specifically so as to form a bottom, common foot or anchor section 27 which merges into the two support halves 24*a*, 24*b* and can be securely held and anchored by means of a screw 28 inserted into the reflector plate 19 from the bottom, for example (FIG. 5). The two dipole halves 23*a* and 23*b* are supported or held by two balun halves 25*a* and 25*b* and, together with the region situated above a shorting element 41, which is yet to be explained, form the balun for the dipole 23. The same applies to the support 30 for the second antenna device 7". In this case too, the balun halves 31*a* and 31*b* are formed by those sections of the support halves 30*a* and 30*b* which are situated above a shorting element 41".

The height and the dipole length are matched to the frequency band range which is to be transmitted and to the radiation graph, to the 1800 MHz band range in this illustrative embodiment.

Seated next to this is the second antenna device 7", this radiating element also being in the form of a dipole radiating element 29 having two dipole halves 29*a* and 29*b* held at the top end of a balun 31 having two balun halves 31*a* and 31*b*. In principle, the design and anchoring on the reflector plate 19 can be similar to those in the case of the first dipole radiating element 23 explained. In the case of this radiating element, the length of the dipole halves and of the balun, and also the height of the support halves, are matched to an appropriately desired radiation graph for transmission of the 900 MHz band range, which is why the length of the dipoles is twice that for the first antenna device 7'.

At the top end of each balun, the antenna device may be provided, if required, with a nonconductive fixing element 35 fixing the two balun halves relative to one another, which merely serves to improve the robustness of the antenna device (FIG. 5).

Emerging from a coaxial connection 1 (not shown in more detail in FIG. 4) is, in the first instance, a common coaxial cable 1' connected to the distribution point or star point 5, as also shown in FIG. 4.

The two branch lines 5', 5" to the two radiating elements 7', 7" then emerge from this star point 5, each of the two branch lines 5', 5" in the illustrative embodiment shown running essentially parallel and adjacent to one of the two balun halves 25*b* for the radiating element 7' or 31*b* for the radiating element 7". As can also be seen from the drawings, in such dipole antennas, the feed is usually effected such that (as can also be seen, in particular, from the schematic illustration shown in FIG. 5) the outer conductor 5'*a* or 5"*a* of the coaxial branch lines 5' or 5" is electrically conductively connected to the feed point 12'*a* at the level of one respective dipole half, for example the dipole half 23*b*, and that the inner conductor 5'*b* (or 5"*b* in the case of the antenna device 7" ) routed out via this associated dipole half 23*b* is electrically conductively connected to the respective second dipole half 23*a* or 29*a* on the inside via a connecting bridge 39' (or 39"). This makes it possible to produce the desired known symmetrical feed 12' (or 12").

Finally, the respective shorting element 41' or 41" mentioned is also provided between the two balun halves 25*a* and 25*b* of the first radiating element 7' and the two balun halves 31*a* and 31*b* of the second radiating element 7", the position and arrangement of said shorting element being chosen such that it is used to match the respective frequency-selective component 11' or 11" of integrated form, for example of bandpass filter type, such that the two radiating elements, i.e. the two frequency-selective components, each reject for one another. This means that the frequency-selective components formed in this way are used to achieve a respective rejection effect for the frequency band range radiated and received via the other radiating element, so that the other frequency-selective component (bandpass filter) is operated as an open circuit for the other frequency band range. The shorting elements 41'*a* nd 41" mentioned limit the effective length of the balun to, in each case, the distance from the top of the associated shorting element 41' or 41" to the height of the dipole radiating elements 23 and 29. In other words, the reflector could per se be provided at the level of these shorting elements (i.e. the top of the shorting elements).

The electrical length of the antenna line or branch line 5' plus the electrical length of the balun (which is equivalent to the length of the balun in this case) from the feed point 12' or 12'*a* to the shorting element 41' or the corresponding electrical length of the antenna line or branch line 5" plus the length of the balun from the feed point 12" or 12"*a* to the shorting element 41" is designed to be of a length such that the sum thereof satisfies the formula below in each case:

Electrical length for the first antenna device 7', 9':

$$L1(\text{GSM } 1800)=\lambda_2/4+n\cdot(\lambda_2/2)$$

and electrical length for the second antenna device 7", 9":

$$L2\ (\text{GSM } 900)=\lambda_1/4+\cdot(\lambda_1/2)$$

where $\lambda_2$ corresponds to the wavelength for the second frequency band range in accordance with the GSM 900 standard (in the present illustrative embodiment) and $\lambda_1$ corresponds to the wavelength for the mobile radio range in accordance with the GSM 1800 standard (in the illustrative embodiment explained), and n can assume the values 0, 1, 2, 3, . . . in this case, that is to say n can be a number from the natural numbers, including the 0. In other words, the electrical total length of the first antenna device 7', 9', for example for the GSM 1800 standard, depends on the wavelength of the frequency band transmitted via the second antenna device, and the electrical total length of the second antenna device depends on the wavelength of the frequency band transmitted via the first antenna device.

In accordance with the illustrative embodiment explained, it is thus possible to provide an integrated bandpass filter solely by means of appropriate proportioning of the electrical length of the associated branch line 5', 5"*a* nd by means of appropriate arrangement of the respective associated shorting element 41', 41"*a* t a suitable height between the two associated balun halves 23*a*, 23*b* and 29*a*, 29*b*, that is to say at a suitable distance from the dipole halves, without the need for separate additional bandpass filter devices.

Since, as detailed above, the total electrical line length from the branch point 5 via the top feed point at the level of the respective dipole halves plus the length from this feed point to the top end of the associated shorting element 41', 41" is crucial for the proportioning to obtain the rejection or open circuit effect, the length of the shorting element and the width can be designed to be different. Hence, the length or height dimension of the respective shorting element 41', 41" can also be chosen to be different, the shorting element additionally being used for the mechanical strength and rigidity of the whole arrangement, for example also producing desired vibration damping.

The example has been explained for a dual-band antenna. The illustrative embodiment can also be implemented generally for an antenna covering more than two bands, however, that is to say generally for a multiband antenna.

What is claimed is:

1. A multiband antenna comprising:

at least first and second antenna devices for transmitting or receiving, said first and second antenna devices each having a dipole structure and associated dipole halves disposed opposite a base plate or reflector by means of baluns;

a feed from a common antenna input line and a branch circuit for each device;

a frequency selective component associated with each of said first and second antenna devices;

said frequency selective components being integrated in the respective antenna devices; and an effective electrical length of the associated baluns and an electrical length of associated branch lines between a branch point and a feed point on the associated antenna devices having said dipole structure enabling said frequency selective components respectively to reject a frequency band range transmitted via another of said first and second antenna devices.

2. A multiband antenna according to claim 1 wherein the electrical length of the branch line plus the effective length of the baluns have a respective electrical total length whose discrepancy from a value of a formula $$\lambda_i/4+n\cdot(\lambda_i/2)$$

is less than 40% where, with reference to the respective antenna devices, the wavelength $\lambda_i$ is equivalent to a wavelength of the frequency band transmitted via said another antenna device and n=0, 1, 2, 3.

3. A multiband antenna according to claim 1 including a shorting element connecting two balun halves of the each device.

4. A multiband antenna according to claim 3 wherein the respective antenna devices are disposed above the reflector by a support device, a height of said support device being greater than the electrically effective length of the balun of the associated antenna device defined by a distance between radiating elements thereof and an associated shorting element.

5. A multiband antenna according to claim 3 wherein the height of the shorting elements with reference to a total distance between the radiating elements of said antenna devices and said reflector is less than 50% of the total height of said support devices for radiating elements of said antenna devices relative to the reflector.

6. A multiband antenna according to claim 3 wherein the shorting elements comprise conductive elements having thicknesses equivalent to a distance between the respectively associated balun halves.

7. A multiband antenna according to claim 3 wherein the shorting elements are soldered in between the two balun halves.

8. A multiband antenna according to claim 3 wherein the shorting elements comprise clamps or screw elements.

9. A multiband antenna according to claim 3 wherein the shorting elements include one or two offsets or angles directed toward one another on the associated balun halves, which are electrically connected to one another.

10. A multiband antenna according to claim 1 including an antenna input line and a branch line being in the form of coaxial cables.

* * * * *